US010119509B2

(12) United States Patent
Yu et al.

(10) Patent No.: US 10,119,509 B2
(45) Date of Patent: Nov. 6, 2018

(54) MULTIPLE STAGE FUEL PUMP

(71) Applicant: COAVIS, Sejong-si (KR)

(72) Inventors: Gyu Sang Yu, Chungcheongbuk-do (KR); Won Young Choi, Daejeon (KR); In Seok Sohn, Chungcheongbuk-do (KR)

(73) Assignee: COAVIS, Sejong-si (KR)

( * ) Notice: Subject to any disclaimer, the term of this patent is extended or adjusted under 35 U.S.C. 154(b) by 421 days.

(21) Appl. No.: 14/930,312

(22) Filed: Nov. 2, 2015

(65) Prior Publication Data

US 2016/0123288 A1 May 5, 2016

(30) Foreign Application Priority Data

Nov. 3, 2014 (KR) ..... 10-2014-0151337

(51) Int. Cl.

| | |
|---|---|
| ***F02M 59/16*** | (2006.01) |
| ***F04D 5/00*** | (2006.01) |
| ***F04D 13/06*** | (2006.01) |
| ***F04D 15/00*** | (2006.01) |
| ***F04D 29/66*** | (2006.01) |

(52) U.S. Cl.

CPC ..... *F02M 59/16* (2013.01); *F04D 5/006* (2013.01); *F04D 13/0653* (2013.01); *F04D 15/0005* (2013.01); *F04D 29/669* (2013.01)

(58) Field of Classification Search

CPC ..... F02M 59/16; F04D 5/006; F04D 29/188; F04D 5/007; F05D 2250/53

USPC ..... 415/55.5, 55.6, 55.7; 416/175, 203

See application file for complete search history.

(56) References Cited

U.S. PATENT DOCUMENTS

| | | | | |
|---|---|---|---|---|
| 4,273,515 A * | 6/1981 | Fitch | F01C 21/08 | 415/119 |
| 5,525,039 A * | 6/1996 | Sieghartner | F04D 5/002 | 417/244 |
| 5,642,981 A * | 7/1997 | Kato | F04D 29/188 | 415/55.1 |
| 5,807,068 A * | 9/1998 | Dobler | F04D 29/188 | 415/55.1 |

FOREIGN PATENT DOCUMENTS

| | | |
|---|---|---|
| JP | 2012162995 A | 8/2012 |
| KR | 1020070025125 A | 3/2007 |

* cited by examiner

*Primary Examiner* — Ninh H Nguyen
*Assistant Examiner* — Brian O Peters
(74) *Attorney, Agent, or Firm* — McCoy Russell LLP

(57) ABSTRACT

A multi-stage fuel pump includes a casing having a fuel intake formed on one side thereof and a fuel discharge port formed on the other side thereof, and a plurality of impellers provided within the casing, having a plurality of blades disposed on a circumferential surface in an outward direction of the circumferential surface and having blade chambers formed between the blades and penetrating through upper and lower surfaces of the impellers to allow fuel to be discharged and introduced to and from upper and lower sides of the blades, and formed in multiple stages, wherein fuel intaken through the fuel intake according to rotation of the impellers is discharged to the fuel discharge port through the blade chambers of the impellers, and the numbers of the blades of each of the impellers are different, thereby reducing blade passage frequency (BPF) noise generated according to rotation of the impellers.

2 Claims, 9 Drawing Sheets

Prior Art

MULTIPLE STAGE FUEL PUMP

CROSS-REFERENCE TO RELATED APPLICATIONS

This application claims priority under 35 U.S.C. § 119 to Korean Patent Application No. 10-2014-0151337, filed on Nov. 3, 2014, in the Korean Intellectual Property Office, the disclosure of which is incorporated herein by reference in its entirety.

TECHNICAL FIELD

The following disclosure relates to a multi-stage fuel pump and, more particularly, to a multi-stage fuel pump installed in a fuel tank of a vehicle to press-feed fuel to an engine, in which impellers having different numbers of blades are provided in multiple stages to reduce blade passage frequency (BPF) noise generated according to rotation of the impellers.

BACKGROUND

A device such as a vehicle driven upon receiving liquid fuel such as a gasoline engine or a diesel engine has a fuel tank storing fuel, a fuel pump module is installed in the fuel tank and connected to an engine through a fuel supply line to supply the fuel stored in the fuel tank to the engine. A fuel pump is provided in the fuel pump module in order to press-feed the fuel filling the interior of the fuel tank toward the engine.

Here, a general fuel pump has a single impeller configured to be rotated, and a fuel pump used in a fuel supply device for liquefied petroleum gas (LPG) such as a liquid phase LPG injection (LPLI) fuel system needs to press-feed fuel at high pressure of 5 bar or higher, and thus, to this end, the fuel supply device for LPG uses two fuel pumps or uses two stages (two impellers are provided in multiple stages) in a single fuel pump.

However, the use of two fuel pumps together causes a side effect such as beating noise due to the combination of the same two fuel pumps, and in the case of the two-stage fuel pump in which impellers are provided in multiple stages, as impellers having the same specification are applied to first and second stages, noise is amplified to be doubled at the same frequency. That is, in a related art multi-stage fuel pump in which a plurality of impellers are provided in multiple stages as illustrated in FIG. 1, two impellers having the same diameter and the same number of blades (having same shape) are applied, increasing BPF noise to fail to satisfy required noise standard.

RELATED ART DOCUMENT

Patent Document

KR 10-2007-0025125 A (2007 Mar. 8)

SUMMARY

An exemplary embodiment of the present invention is directed to a multi-stage fuel pump in which impellers having different numbers of blades are provided in multiple stages to reduce blade passage frequency (BPF) noise generated due to rotation of the impellers.

In one general aspect, a multi-stage fuel pump (1000) includes: a casing (100) having a fuel intake (131) formed on one side thereof and a fuel discharge port (111) formed on the other side thereof; and a plurality of impellers (200) provided within the casing (100), having a plurality of blades (230) disposed on a circumferential surface in an outward direction of the circumferential surface and having blade chambers (240) formed between the blades (230) and penetrating through upper and lower surfaces of the impellers (200) to allow fuel to be discharged and introduced to and from upper and lower sides of the blades (230), and formed in multiple stages, wherein a flow channel is formed such that fuel intaken through the fuel intake (131) according to rotation of the impellers (200) is discharged to the fuel discharge port (111) through the blade chambers (240) of the impellers (200), and the numbers of blades (230) of each of the impellers are different.

The impellers (200) may be formed to have different outer diameters and have different numbers of blades (230), or may be formed to have the same outer diameter and have different numbers of blades (200).

The fuel intake (131) may be connected to a fuel inlet side of one impeller (200), the fuel discharge port (111) may be connected to a fuel outlet side of another impeller (200), and a serial connection flow channel (125) connecting the fuel outlet sides and the fuel inlet sides of the impellers (200) may be formed in the casing (100).

The fuel intake (131) may be connected to each of the fuel inlet sides of the impellers and the fuel discharge port (111) may be connected to each of the fuel outlet sides of the impellers.

The casing (100) may include an upper casing (110) having an upper flow channel recess (112) formed on a lower surface thereof and allowing fuel to flow therein and the fuel discharge port (1110) connected to the upper flow channel recess (112) and allowing fuel to be discharged by penetrating through the upper and lower surfaces thereof; an intermediate casing (120) coupled to a lower side of the upper casing (110) having an intermediate upper flow channel recess (121) formed on an upper surface thereof and allowing fuel to flow therein and an intermediate lower flow channel recess (122) formed on a lower surface thereof and allowing fuel to flow therein; and a lower casing (130) coupled to a lower side of the intermediate casing (120) and having a lower flow channel recess (132) formed on an upper surface thereof and allowing fuel to flow therein and the fuel intake (131) connected to the lower flow channel recess (132) and allowing fuel to be introduced by penetrating through the upper and lower surfaces thereof, wherein the impellers (200) are provided in a space between the upper casing (110) and the intermediate casing (120) and a space between the intermediate casing (120) and the lower casing (130), respectively.

An intake flow channel (123) may be formed in the intermediate casing (120) such that the fuel inlet side and the fuel intake (131) of another impeller (200) are connected through the fuel inlet side of one impeller (200), or the intake flow channel (123) may be formed in the intermediate casing (120) and the lower casing (130) such that the fuel inlet side and the fuel intake (131) of another impeller (200) are connected without passing through the fuel inlet side of one impeller (200), and a discharge flow channel (124) may be formed in the upper casing (110) and the intermediate casing (120) such that each of the fuel outlet sides of the impellers (200) is connected to the fuel discharge port (111).

A serial connection flow channel (125) connecting the fuel outlet side of one impeller (200) and the fuel inlet side of another impeller (200) may be formed in the intermediate casing (120).

According to the multi-stage fuel pump of the present invention, since the impellers having different numbers of blades are provided in multiple stages in the multi-stage fuel pump, when the impellers are rotated, the BPF noise generated by the impellers do not overlap to be amplified, thus reducing BPF noise generated according to rotation of the impellers.

DETAILED DESCRIPTION OF EXEMPLARY EMBODIMENTS

Hereinafter, a multi-stage fuel pump according to an exemplary embodiment of the present invention will be described in detail with reference to the accompanying drawings.

First, the multi-stage fuel pump according to an exemplary embodiment of the present invention is a turbine-type fuel pump for a vehicle installed in a fuel tank of a vehicle and press-feeding fuel to supply it to an engine and multi-stage fuel pump in which impellers having different numbers of blades are provided in multiple stages. Also, the multi-stage fuel pump according to an exemplary embodiment of the present invention may be a multi-stage fuel pump in which two or more impellers are provided. Hereinafter, an exemplary embodiment of a multi-stage fuel pump including two impellers will be described.

Figure 1:
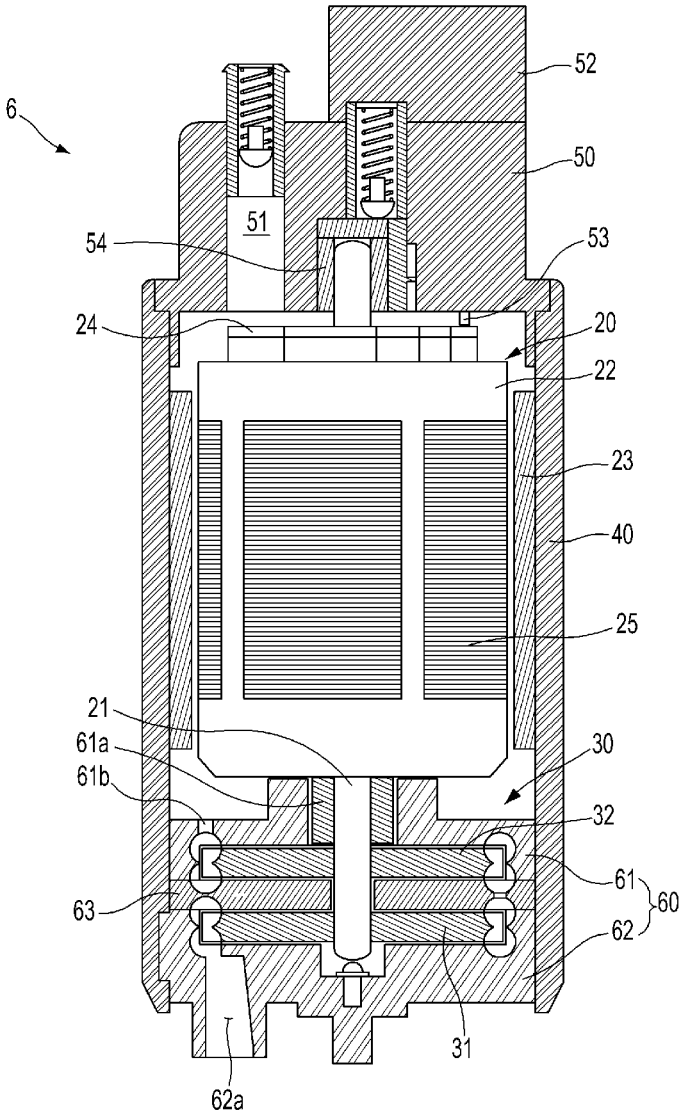
FIG. 1 is a perspective view of the related art multi-stage fuel pump.
Figure 2:
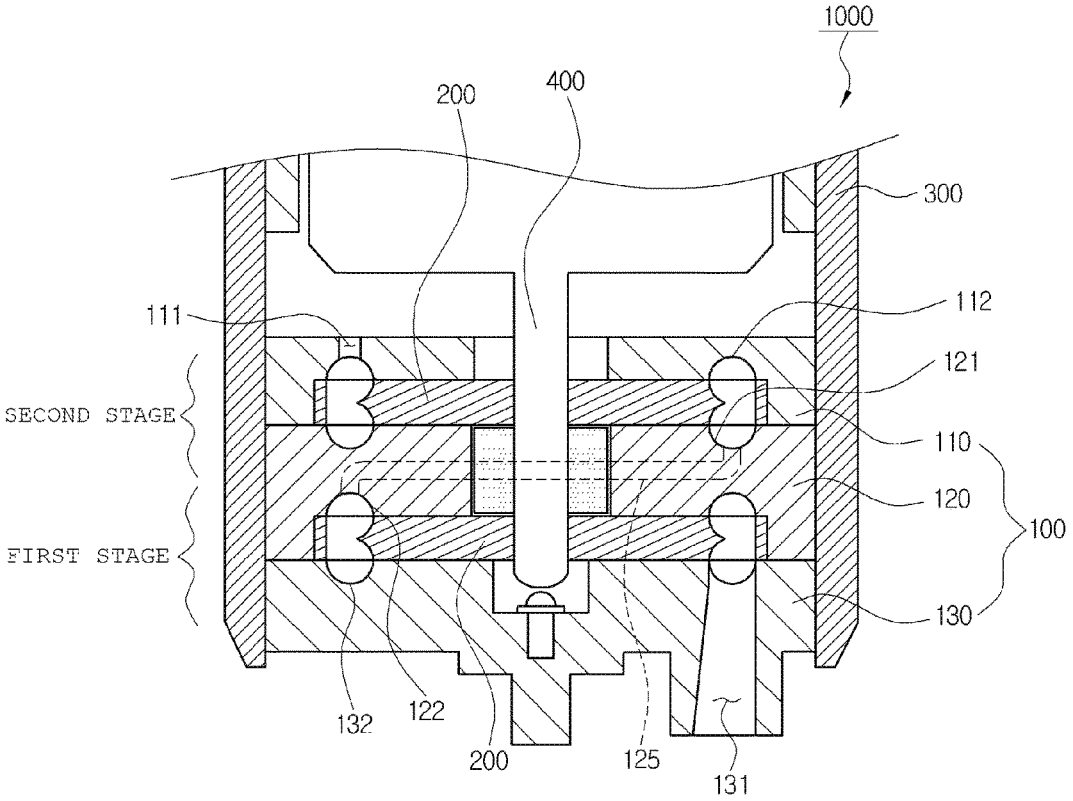
FIG. 2 is a front cross-sectional view of a multi-stage fuel pump according to an exemplary embodiment of the present invention.
Figure 3:
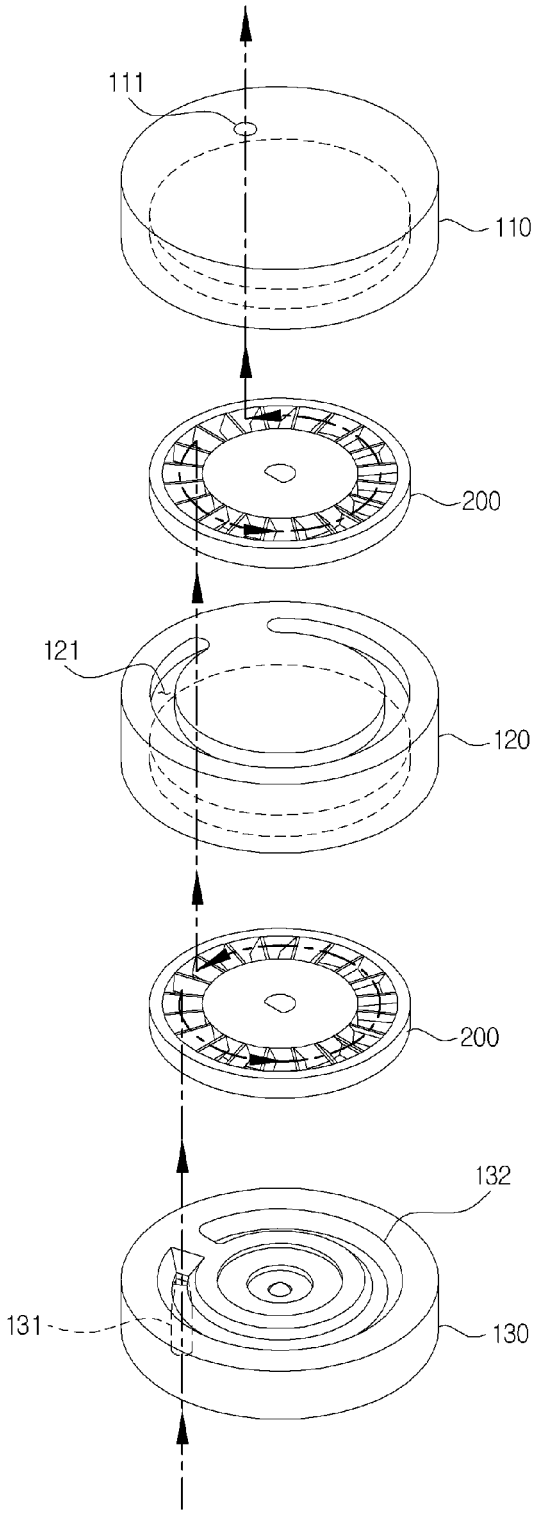
FIG. 3 is an exploded perspective view illustrating a flow path of fuel in a state in which a multi-stage fuel pump and impellers are connected in series according to an exemplary embodiment of the present invention.

FIG. 2 is a front cross-sectional view of a multi-stage fuel pump according to an exemplary embodiment of the present invention, and FIG. 3 is an exploded perspective view illustrating a flow path of fuel in a state in which a multi-stage fuel pump and impellers are connected in series according to an exemplary embodiment of the present invention.

As illustrated in FIGS. 2 and 3, a multi-stage fuel pump 1000 according to an exemplary embodiment of the present invention includes a casing 100 having a fuel intake 131 formed on one side thereof and a fuel discharge port 111 formed on the other side thereof, and a plurality of impellers 200 provided within the casing 100, having a plurality of blades 230 disposed on a circumferential surface in an outward direction of the circumferential surface and having blade chambers 240 formed between the blades 230 and penetrating through upper and lower surfaces of the impellers 200 to allow fuel to be discharged and introduced to and from upper and lower sides of the blades 230, and formed in multiple stages. A flow channel is formed such that fuel intaken through the fuel intake 131 according to rotation of the impellers 200 is discharged to the fuel discharge port 111 through the blade chambers 240 of the impellers 200, and here, the numbers of the blades 230 of the impellers 200 are different.

The fuel intake 131, to which fuel is intaken, is formed on one side (a lower side) of the casing 100, and the fuel discharge port 111, from which fuel is discharged, is formed on the other side (an upper side) of the casing 100. Spaces allowing the impellers 200 to be positioned are formed in the casing 100. The spaces may communicate with each other and may be connected to the fuel intake 131 and the fuel discharge port 111. Also, the casing 100 may be fixedly coupled to a lower end of a housing 300 forming the fuel pump.

The impellers 200 are provided in an internal space of the casing 100. The impellers 200 may have a disk shape. A plurality of blades 230 are disposed to be spaced apart from one another along a circumferential surface of an impeller body 210, and here, the plurality of blades 230 may be formed in an outward direction of the circumferential surface of the impeller body 210. In the impellers 200, the blade chambers 240 are formed to penetrate through the upper and lower surfaces of the blades 230 such that fuel may be discharged and introduced above and below the blades 230. Also, in the impellers 200, a side ring 250 is formed to connect the plurality of blades 230 to enclose an outer surface of the plurality of blades 230, and the blade chambers 240 are formed between the blades 230 to penetrate through upper and lower surfaces. Fuel may be introduced to a lower side of the blade chamber 240 and discharged from the upper side of the blade chamber 240.

Two or more impellers 200 may be provided and formed in multiple stages and disposed in two upper and lower stages between the fuel intake 131 and the fuel discharge port 111 of the casing 100. The impellers 200 are coupled to a rotary driving shaft 400 coupled to a motor provided within the housing 300 of the fuel pump. That is, in the impellers 200, a shaft coupling hole 220 may be formed at the center of the impeller body 210 and the driving shaft 400 of the motor may be coupled to the shaft coupling hole 220, and as the driving shaft 400 rotates, the two impellers 200 may be rotated together.

Figure 4:
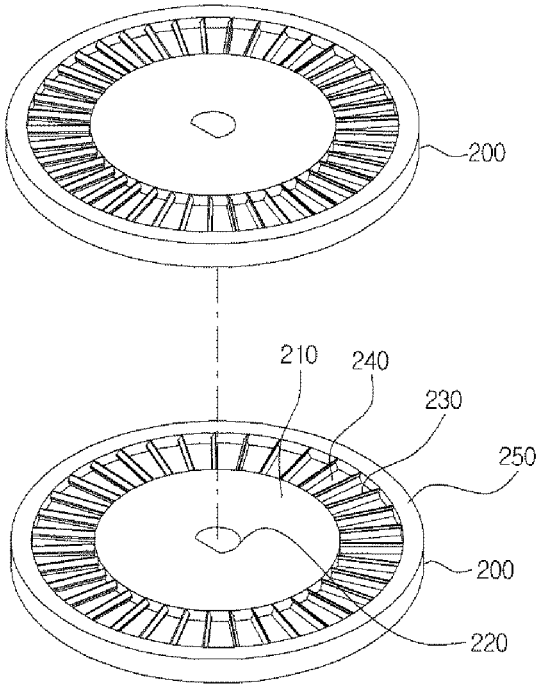
FIG. 4 is a perspective view of impellers according to an exemplary embodiment of the present invention.

A flow channel may be formed such that fuel is intaken through the fuel intake 131 according to rotation of the impellers 200 and is discharged to the fuel discharge port 111 through the blade chambers 240 of the impellers 200. The impellers 200 have different numbers of blades 230. For example, the number of the blades 230 of the impeller 200 at a first stage may be 41 and the number of blades 230 of the impeller 200 at a second stage may be 35, or vice versa (please refer to FIG. 4).

Thus, blade passage frequency (BPF) noise generated as the impellers 200 rotate may not overlap to be amplified but reduced. Also, beating noise that may be generated when two fuel pumps are used together is not generated, and even though the impellers are provided in multiple stages, shortcomings of a multi-stage fuel pump in which impellers having the same number of blades are formed in multiple stages and thus noise having the same frequency band is doubly amplified may be prevented, reducing BPF noise.

In this manner, since the impellers having different numbers of blades are provided in multiple stages in the multi-stage fuel pump of the present invention, the BPF noise generated by the respective impellers does not overlap to prevent amplification when the impellers rotate, reducing BPF noise generated according to rotation of the impellers.

Also, the impellers have advantages and drawbacks in terms of efficiency according to operation regions of a high flow rate or a low flow rate. That is, as the number of blades is greater, efficiency is obtained in the low flow rate region, and as the number of blades is smaller, efficiency is obtained in the high flow rate region. Thus, when the impellers formed to have different numbers of blades are applied as in the present invention, advantages may be obtained in the high flow rate region and the low flow rate region.

Figure 5:
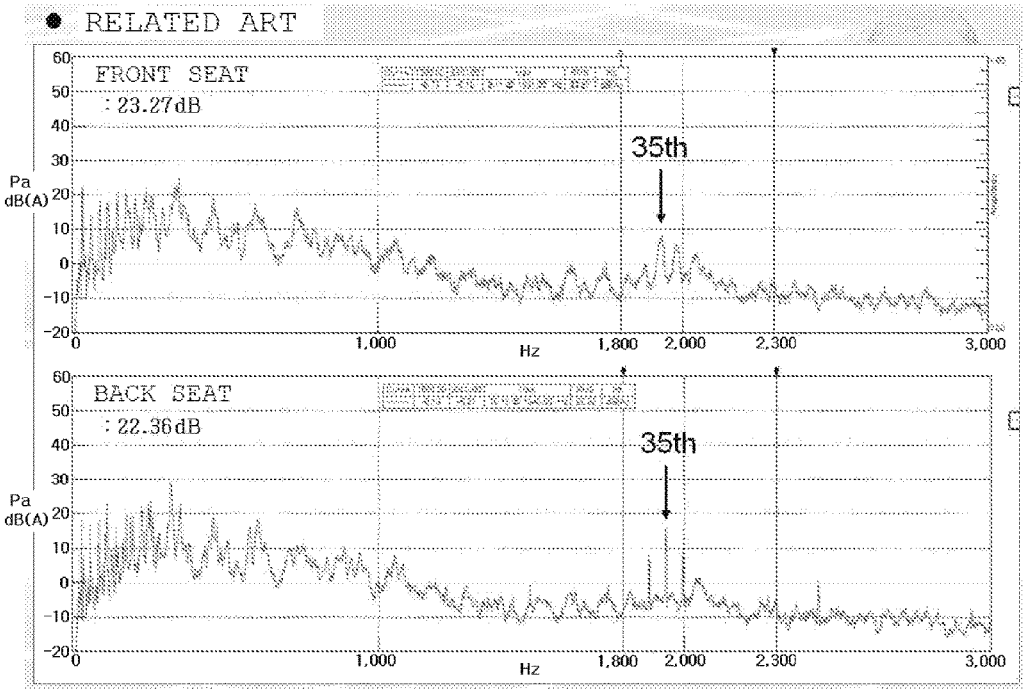
FIG. 5 is a graph illustrating measurement of noise of multi-stage fuel pump including two impellers having the same number of blades according to the related art.
Figure 6:
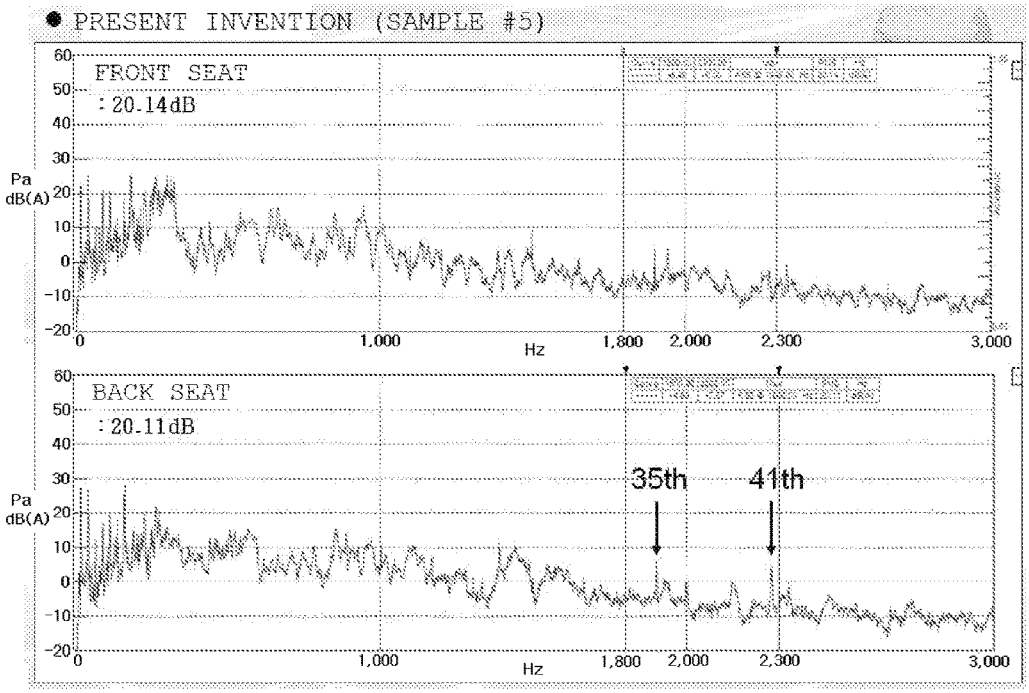
FIG. 6 is a graph illustrating measurement of noise of multi-stage fuel pump including two impellers having different numbers of blades according to an exemplary embodiment of the present invention.

FIG. 5 is a graph illustrating measurement of noise of multi-stage fuel pump including two impellers having the same number of blades according to the related art, and FIG. 6 is a graph illustrating measurement of noise of multi-stage fuel pump including two impellers having different numbers of blades according to an exemplary embodiment of the present invention. Also, Table 1 below shows comparison results obtained by measuring noise of the related art multi-stage fuel pump and noise of the multi-stage fuel pump according to the present invention.

TABLE 1

Evaluation results

| | Related art | Present invention (nine impellers were measured) |
|---|---|---|
| Number of blades | First stage impellers: 35<br>Second stage impellers: 35 | First stage impellers: 41<br>Second stage impellers: 35 |
| Front seat noise | RMS (1,800 to 2,300 Hz): 23.79 dB | RMS (1,800 to 2,300 Hz): 18.05 to 20.32 dB |
| Back seat noise | RMS (1,800 to 2,300 Hz): 22.36 dB | RMS (1,800 to 2,300 Hz): 15.31 to 20.34 dB |

* Noise level is an RMS value in the vicinity of generation frequency

As illustrated in the graph and table, it can be seen that the multi-stage fuel pump of the present invention has an effect of improving noise by 3.47 dB to 5.74 dB at the front seat of a vehicle and by 2.02 dB to 7.05 dB at the back seat of the vehicle with respect to a root mean square (RMS), compared with the related art multi-stage fuel pump.

Hereinafter, various exemplary embodiments of the present invention will be described.

The impellers 200 may be formed to have different outer diameters and have different numbers of blades 230, or may be formed to have the same outer diameter and have different numbers of blades 230.

Figure 7:
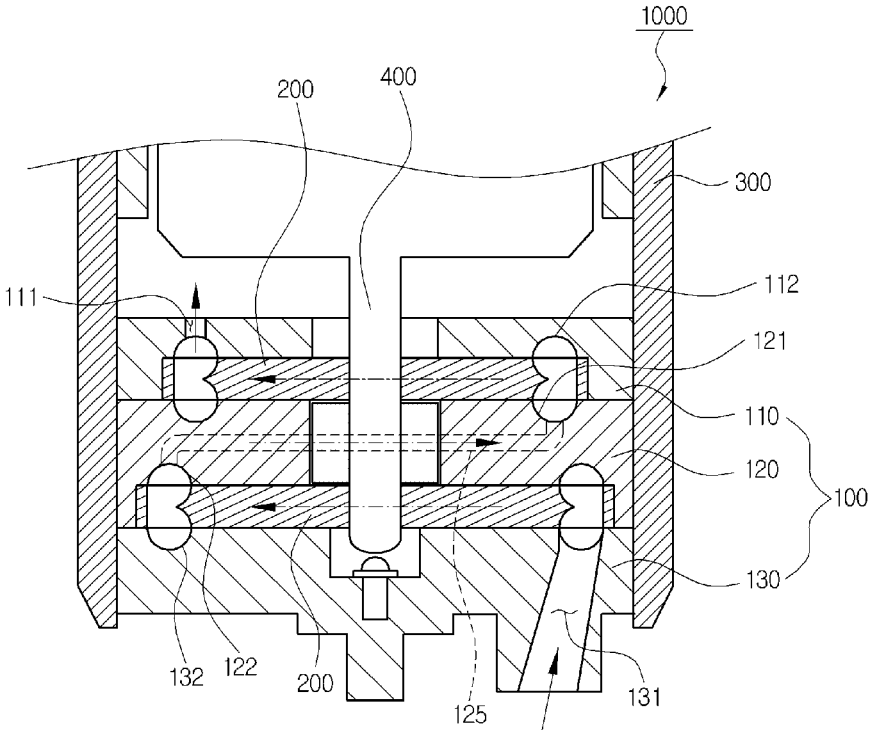
FIG. 7 is a front cross-sectional view illustrating an exemplary embodiment in which two impellers having different diameters are connected in series according to the present invention.

That is, as illustrated in FIG. 7, the impellers 200 may have different outer diameters and have different numbers of blades 230, or may have the same outer diameter and different numbers of blades 230.

Thus, in a case in which the two impellers 200 having different numbers of blades 230 are formed to have different outer diameters, the two impellers 200 may be prevented from being reversed in disposition, and in a case in which the two impellers 200 having different numbers of blades 230 are formed to have the same outer diameter, spaces in which the impellers 200 are provided in the casing 100 may be formed to be the same, and thus, the two impellers 200 may be freely disposed.

Also, the fuel intake 131 may be connected to a fuel inlet side of one impeller 200, the fuel discharge port 111 may be connected to a fuel outlet side of another impeller 200, and a serial connection flow channel 125 connecting the fuel outlet sides and the fuel inlet sides of the impellers 200 may be formed in the casing 100.

That is, the first stage impeller 200 and the second stage impeller 200 may be connected in series, and fuel introduced through the fuel intake 131 may be introduced to the fuel inlet side of the impeller 200 at the first stage, may be discharged to the fuel outlet side thereof, may flow along the serial connection flow channel 125, may be introduced to the fuel inlet side of the impeller 200 of the second stage, may be discharged to the fuel outlet side thereof, and may subsequently be discharged through the fuel discharge opening 111. Here, a lower portion of the serial connection flow channel 125 may be connected to the fuel outlet side of the first stage impeller 200, and an upper portion thereof may be connected to the fuel inlet side of the second stage impeller 200.

Also, the fuel intake 131 may be connected to each of the fuel inlet sides of the impellers 200 and the fuel discharge port 111 may be connected to each of the fuel outlet sides of the impellers 200.

Figure 8:
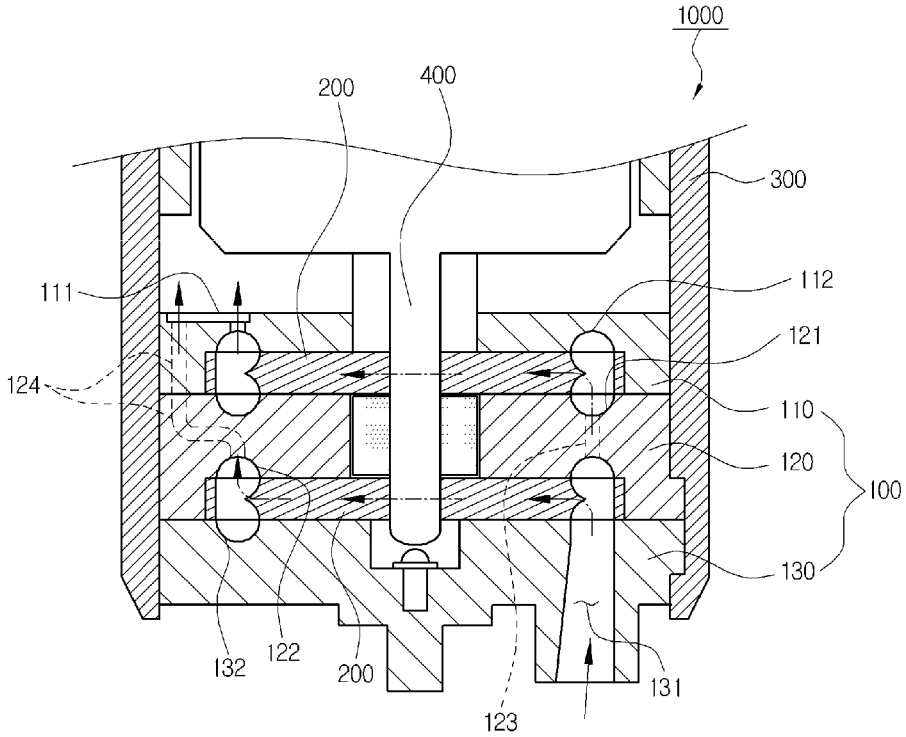
FIGS. 8 and 9 are front cross-sectional views illustrating exemplary embodiments in which two impellers are connected in parallel according to the present invention.
Figure 9:
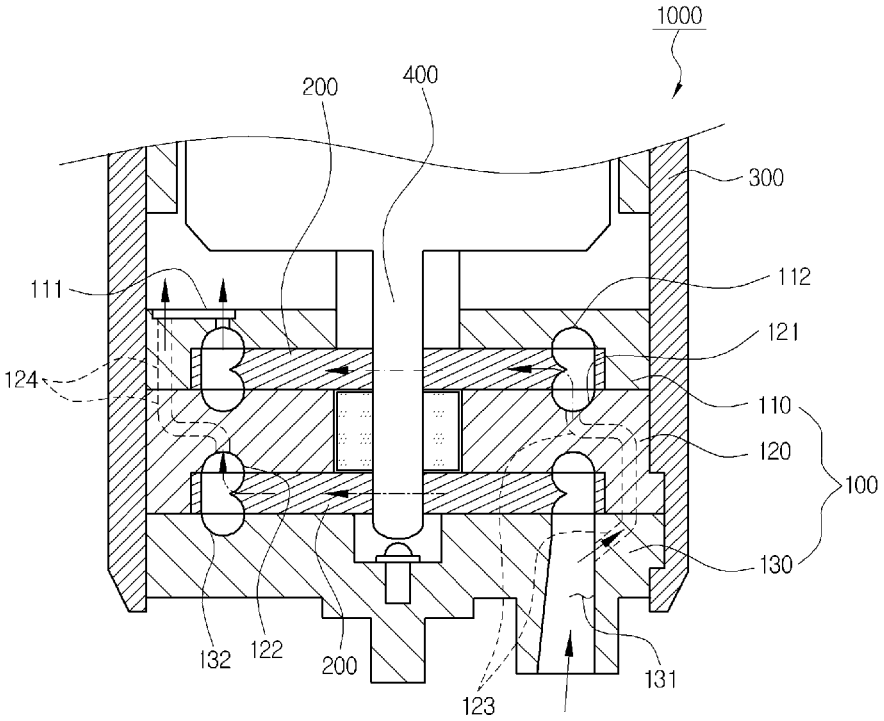

That is, as illustrated in FIGS. 8 and 9, the first stage impeller 200 and the second stage impeller 200 may be connected in parallel, and fuel introduced through the fuel intake 131 may be introduced to each of the fuel inlet side of the first stage impeller 200 and the fuel inlet side of the second stage impeller 200, may be discharged to each of the fuel outlet side of the first stage impeller 200 and the fuel outlet side of the second stage impeller 200, and may be discharged through the fuel discharge port 111.

Also, the casing 100 may include an upper casing 110 having an upper flow channel recess 112 formed on a lower surface thereof and allowing fuel to flow therein and the fuel discharge port 111 connected to the upper flow channel recess 112 and allowing fuel to be discharged by penetrating through the upper and lower surfaces thereof; an intermediate casing 120 coupled to a lower side of the upper casing 110 and having an intermediate upper flow channel recess 121 formed on an upper surface thereof and allowing fuel to flow therein and an intermediate lower flow channel recess 122 formed on a lower surface thereof and allowing fuel to flow therein; and a lower casing 130 coupled to a lower side of the intermediate casing 120 and having a lower flow channel recess 132 formed on an upper surface thereof and allowing fuel to flow therein and the fuel intake 131 connected to the lower flow channel recess 132 and allowing fuel to be introduced by penetrating through the upper and lower surfaces thereof. The impellers 200 may be provided in a space between the upper casing 110 and the intermediate casing 120 and a space between the intermediate casing 120 and the lower casing 130, respectively.

That is, the casing 100 may be formed such that the two impellers 200 are provided and connected in series or in parallel therein, and in a case in which two impellers 200 are provided, the casing 100 may include the upper casing 110, the intermediate casing 120, and the lower casing 130, and here, the upper casing 110, the intermediate casing 120, and the lower casing 130 may be tightly coupled to each other. Here, one impeller 200 may be provided in the space between the upper casing 110 and the intermediate casing 120, and another impeller 200 may be provided in the space between the intermediate casing 120 and the lower casing 130. Also, the flow channel recesses may respectively be formed in the casings such that, when the impellers 200 rotate, fuel is introduced to the lower side of the blade chambers 240 and discharged from the upper side of the blade chambers 240 and such that fuel is rotated to flow on the upper side and on the lower side of the blade chambers 240.

Also, an intake flow channel 123 may be formed in the intermediate casing 120 such that the fuel inlet side and the fuel intake 131 of another impeller 200 are connected through the fuel inlet side of one impeller 200, or the intake flow channel 123 may be formed in the intermediate casing 120 and the lower casing 130 such that the fuel inlet side and the fuel intake 131 of another impeller 200 are connected without passing through the fuel inlet side of one impeller 200, and a discharge flow channel 124 may be formed in the upper casing 110 and the intermediate casing 120 such that each of the fuel outlet sides of the impellers 200 is connected to the fuel discharge port 111.

That is, in a case in which two impellers 200 are formed in parallel, flow channels are formed to connect the fuel inlet sides of the impellers 200 to the fuel intake 131 and connect the fuel outlet sides of the impellers 200 to the fuel discharge port 111.

Here, as illustrated in FIG. 8, the intake flow channel 123 may be formed such that fuel intaken through the fuel intake 131 passes through the fuel inlet side of the first stage impeller 200 and is connected to the fuel inlet side of another impeller 200. That is, fuel passing through the blade chambers 240 from the fuel inlet side of the first stage impeller 200 may be intaken to the fuel inlet side of the second stage impeller 200 through the intake flow channel 123. Also, as illustrated in FIG. 9, the intake flow channel 123 may be formed such that each of the fuel inlet side of the first stage impeller 200 and the fuel inlet side of the second stage impeller 200 is connected to the fuel intake 131 and branched from the fuel intake 131 of the lower casing 130. Also, after fuel is intaken, fuel discharged as pressure is increased according to rotation of the impellers 200 may be connected to the fuel discharge port 111 through the discharge flow channel 124 formed in the upper casing 110 and the intermediate casing 120.

The discharge flow channel 124 may be formed such that the fuel outlet sides of the impellers 200 are connected to the fuel discharge port 111.

Also, the serial connection flow channel 125 connecting the fuel outlet side of one impeller 200 and the fuel inlet side of another impeller 200 may be formed in the intermediate casing 120.

That is, as described above, the first stage impeller 200 and the second stage impeller 200 are connected in series, fuel introduced through the fuel intake 131 is introduced to the fuel inlet side of the first stage impeller 200, is discharged to the fuel outlet side, flows along the serial connection flow channel 125 formed in the intermediate casing 120, is introduced to the fuel inlet side of the second stage impeller 200, is discharged to the fuel outlet side thereof, and is subsequently discharged through the fuel discharge port 111.

The blades 230 of the impellers 200 may have various shapes. For example, the blades 230 may be formed to have a flat plate shape or "〈" shaped plate shape radially formed, formed to be sloped in a radial direction, or formed to be sloped radially or in a radial direction but have a bent lightning shape (or a z-shape), rather than a linear shape.

The present invention is not to be construed as being limited to the above-mentioned exemplary embodiment. The present invention may be applied to various fields and may be variously modified by those skilled in the art without departing from the scope of the present invention claimed in the claims. Therefore, it is obvious to those skilled in the art that these alterations and modifications fall in the scope of the present invention.

DESCRIPTION OF REFERENCE NUMERALS

1000: multi-stage fuel pump
100: casing
110: upper casing
111: fuel discharge port
112: upper flow channel recess
120: intermediate casing
121: intermediate upper flow channel recess
122: intermediate lower flow channel recess
123: intake flow channel
124: discharge flow channel
125: serial connection flow channel
130: lower casing
131: fuel intake
132: lower flow channel recess
200: impeller
210: impeller body
220: shaft coupling hole
230: blade
240: blade chamber
250: side ring
300: housing
400: driving shaft

What is claimed is:

1. A multi-stage fuel pump comprising:

a casing having a fuel intake formed on one side thereof and a fuel discharge port formed on the other side thereof; and a plurality of impellers provided within the casing, having a plurality of blades disposed on a circumferential surface in an outward direction of the circumferential surface and having blade chambers formed between the blades and penetrating through upper and lower surfaces of the impellers to allow fuel to be discharged and introduced to and from upper and lower sides of the blades, and formed in multiple stages, wherein a flow channel is formed such that fuel intaken through the fuel intake according to rotation of the impellers is discharged to the fuel discharge port through the blade chambers of the impellers, and the numbers of the blades of each of the impellers are different, wherein the casing comprises:

an upper casing having an upper flow channel recess formed on a lower surface thereof and allowing fuel to flow therein and the fuel discharge port connected to the upper flow channel recess and allowing fuel to be discharged by penetrating through upper and lower surfaces thereof;

an intermediate casing coupled to a lower side of the upper casing having an intermediate upper flow channel recess formed on an upper surface thereof and allowing fuel to flow therein and an intermediate lower flow channel recess formed on a lower surface thereof and allowing fuel to flow therein; and a lower casing coupled to a lower side of the intermediate casing and having a lower flow channel recess formed on an upper surface thereof and allowing fuel to flow therein and the fuel intake connected to the lower flow channel recess and allowing fuel to flow by penetrating through upper and lower surfaces thereof, wherein the impellers are provided in a space between the upper casing and the intermediate casing and a space between the intermediate casing and the lower casing, respectively, wherein an intake flow channel is formed in the intermediate casing such that a fuel inlet side and the fuel intake of another impeller are connected through a fuel inlet side of one impeller; and a discharge flow channel is formed in the upper casing and the intermediate casing such that each of fuel outlet sides of the impellers is connected to the fuel discharge port.

2. The multi-stage fuel pump of claim 1, wherein the impellers are formed to have different outer diameters and have different numbers of blades, or are formed to have the same outer diameter and have different numbers of blades.

* * * * *